US006978750B2

(12) United States Patent
Yamazaki

(10) Patent No.: US 6,978,750 B2
(45) Date of Patent: Dec. 27, 2005

(54) CAM FOLLOWER PROVIDED WITH ROCKER ARM MADE OF SHEET METAL

(75) Inventor: Kiyoshi Yamazaki, Kanagawa-ken (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 10/496,585

(22) PCT Filed: Nov. 22, 2002

(86) PCT No.: PCT/JP02/12242

§ 371 (c)(1),
(2), (4) Date: Jul. 30, 2004

(87) PCT Pub. No.: WO03/064821

PCT Pub. Date: Aug. 7, 2003

(65) Prior Publication Data

US 2004/0244749 A1 Dec. 9, 2004

(30) Foreign Application Priority Data

Feb. 1, 2002 (JP) ..... 2002-025360

(51) Int. Cl.[7] ..... F01L 1/18
(52) U.S. Cl. ..... 123/90.39; 123/90.43; 123/90.44; 29/888.2
(58) Field of Search ..... 123/90.16, 90.27, 123/90.39, 90.43, 90.44; 74/559, 569; 29/888.2

(56) References Cited

U.S. PATENT DOCUMENTS 4,697,473 A 10/1987 Patel ..... 74/519
4,872,429 A * 10/1989 Anderson et al. ..... 123/90.44
5,010,857 A * 4/1991 Hempelmann et al. .. 123/90.39
5,048,475 A 9/1991 Mills ..... 123/90.39
5,665,490 A * 9/1997 Takeuchi et al. ..... 429/314

FOREIGN PATENT DOCUMENTS

| | | |
|---|---|---|
| JP | 62-7908 | 1/1987 |
| JP | 3-172506 | 7/1991 |
| JP | 4-44289 | 10/1992 |
| JP | 5-272310 | 10/1993 |
| JP | 6-19763 | 5/1994 |
| JP | 6-74006 | 6/1994 |
| JP | 6-81892 B2 | 10/1994 |
| JP | 3120068 | 10/2000 |

* cited by examiner

*Primary Examiner*—Thomas Denion
*Assistant Examiner*—Ching Chang
(74) *Attorney, Agent, or Firm*—Miles & Stockbridge P.C.

(57) ABSTRACT

The thickness in the width direction of a pair of side wall sections 4 is made as uniform as possible. In use, a load is applied to the pivot 3 from the side of the first and second connecting sections 5, 6 which connect the pair of side wall sections 4. A crimped section 13*a* is formed on the outer periphery at the opposite end surfaces of the pivot 3*b*, on the half on the side of the connecting sections 5, 6. Therefore, the outer peripheral surface of the opposite ends of the pivot 3*b* comes into contact with the inner peripheral surface of the through hole 11 on the load support side. Consequently, the load is sufficiently supported by the contact surface, and even after being used for a long time of period, lost motion is prevented from occurring on the support section at the opposite ends of the pivot 3 with respect to the pair of side wall section 4.

3 Claims, 8 Drawing Sheets

CAM FOLLOWER PROVIDED WITH ROCKER ARM MADE OF SHEET METAL

TECHNICAL FIELD OF THE INVENTION

This invention relates to the improvement of a cam follower having a sheet-metal rocker arm that is manufactured by press working of metal plate.

BACKGROUND OF THE INVENTION

In reciprocating engines (reciprocating piston engines), except for some 2-cycle engines, there are air-intake valves and exhaust valves that open and close in synchronization with the rotation of the crankshaft. Also, there is a cam follower inside the valve mechanism of the engine that converts the rotation of the camshaft to the reciprocating motion of the valve stem (air-intake valve and exhaust valve). In this kind of reciprocating engine, the motion of the camshaft that rotates in synchronization with the rotation of the crankshaft (the rotating speed of the camshaft is ½ that of the crankshaft in the case of a 4-cycle engine) is transmitted to the air-intake valve and exhaust valve by the rocker arm of the cam follower to move the air-intake valve and exhaust valve in a reciprocating motion in the axial direction.

In order to secure the strength of the rocker arm inside the valve mechanism of the engine, while at the same time make it more lightweight, it has been proposed and put in practice to manufacture the rocker arm by press-working metal plate such as steel plate. Of this kind of cam follower having a sheet-metal rocker arm, FIGS. 8 thru 11 show a cam follower that is disclosed in U.S. Pat. No. 5,048,475. This cam follower comprises a sheet-metal rocker arm 1, roller 2 and pivot 3, where the roller 2 is supported by the pivot 3 such that it rotates freely with respect to the sheet-metal rocker arm 1.

The sheet-metal rocker arm 1 is associated with the valve stem 7 of the air-intake or exhaust valve (not shown in the figure), the plunger 8 of the rush adjuster, which is the center of the rocking motion of the sheet-metal rocker arm 1, and the camshaft 9. The sheet-metal rocker arm 1 is made from a metal plate such as a 2 mm to 4 mm thick steel plate by a punching process to remove any unnecessary parts, and plastic-working, such as drawing, for obtaining the desired shape; and it comprises a pair of side-wall sections 4 and first and second connecting sections 5, 6 that connect both of these wall sections 4 together, respectively. Of the connecting sections 5, 6, the first connecting section 5 comes in contact against the base end face of the valve stem 7 and functions as a pressure portion for displacing the valve stem 7, and the second connecting section 6 functions as a fulcrum portion for coming in contact with the tip end face of the plunger 8. Therefore, in the example shown in the figures, a spherical concave section is formed on one end surface (lower surface in FIG. 10) of the second connecting section 6. Construction that differs from that of the example shown in the figure, in which a screw hole is formed in the section that corresponds to the second connection section, so as to threadably receive an adjust screw with a spherical surface end for fixing, is also known.

On the other hand, the roller 2 is located between the pair of connecting sections 5, 6, and supported by the pivot 3 by such that it can rotate freely. In order to support the roller 2, both end sections of the pivot 3 fit in the through-holes that are formed at matching locations in the pair of wall sections 4. The outer peripheral edge sections of both end surface of this pivot 3 are crimped outward toward the peripheral edge sections of each of these through-holes. With this construction, both end sections of the pivot 3 are attached to the pair of wall sections 4 such that the pivot 3 spans between both of these wall sections 4. The roller 2 fits around the middle section of the pivot 3 that spans between both of these wall sections 4 in this way, and is supported either directly or by way of a radial needle roller bearing such that it can rotate freely.

As shown in FIG. 11, when installed in the engine, one surface of the first connecting section 5 (bottom surface in FIG. 11) comes in contact with the base end face of the valve stem 7, and the tip end face of the plunger 8 comes in contact with the spherical concave section on one surface of the second connecting section 6, and the outer peripheral surface of the cam 9 securely fastened in the middle section of the cam shaft comes in contact with the outer peripheral surface of the roller 2. When the engine is running, as the cam 9 rotates, the sheet-metal rocker arm 1 moves in a rocking motion with the point of contact between the tip end surface of the plunger 8 and the spherical concave section as the center (fulcrum), and the pressure force from the first connecting section 5 and the elastic force of a return spring 10 moves the valve stem 7 in a reciprocating motion in the axial direction. Incidentally, a cam follower with a sheet-metal rocker arm having similar construction is also disclosed in Japanese Patent Publication No. Tokukou Hei 6-81892, which is not shown in the figures here.

The thickness of the sheet-metal rocker arm 1 made by plastic-working of sheet-metal changes during the plastic-working process, so if the shape and construction of the other parts are not designed properly, it may not be possible-to secure sufficient durability. This aspect is explained using FIGS. 12 thru 14 in addition to FIGS. 8 thru 11, mentioned above.

When a sheet-metal rocker arm 1 like that shown in FIGS. 8 to 11 is manufactured by drawing of a metal plate such as a steel plate, in a normal processing method, with regard to both end sections in the width direction (top and bottom direction in FIGS. 10 and 11) of the pair of side-wall sections 4, the end sections on the side of the first and second connecting sections 5, 6 (top side in FIGS. 10 and 11) stretch in the planar direction an amount more than the end sections on the other side (bottom side in FIGS. 10 and 11) and thus the thickness becomes thinner in the end sections on the side of the first and second connecting sections 5, 6. That is, as shown exaggeratedly in FIGS. 12 and 14, the cross-sectional shape in the width direction of both of the side-wall sections 4 is a wedge shape that is inclined in a direction such that it becomes thicker moving away from the connecting sections 5, 6 (going lower in FIGS. 12, 14). On the other hand, the inner side surfaces of these sidewall sections 4 must be parallel with each other. The reason for that is to prevent that only one of these side wall sections 4 comes into contact with the roller 2 located between these sidewall sections 4, so that the roller 2 can rotate smoothly between the side wall sections 4.

When the inner side surfaces of these side-wall section 4 having a wedge-shaped cross-sectional shape are arranged such that they are parallel with each other, the outer side surface of the side-wall sections 4 are not parallel with each other as shown in FIGS. 12 and 14. That is, the space between the outer side surfaces of these sidewall sections 4 gradually becomes large as it goes away from the connecting sections 5, 6 (to the bottom in FIGS. 12 an 14). The space between the outer side surfaces of the sidewall sections 4 in this way similarly gradually changes in the middle section in the width direction of these sidewall sections 4 where through holes 11 are formed for attaching both ends of the pivot 3. For example, in the results of the tests and measurement performed by the inventors, the thickness of the side-wall sections 4 was approximately 1 mm along the edge on the side of the connecting sections 5, 6 (top edge in FIGS. 12 and 14), and was approximately 3 mm along the edge on the opposite side (bottom edge in FIG. 12). In this case, the thickness of the edge of the through holes 11 was 2.3 mm on the side of the connecting sections 5, 6 and was 2.9 mm on the opposite side. The difference in this thickness is the degree that the outer side surfaces of the sidewall sections 4 are not parallel.

In this state with the outer side surfaces of the sidewall sections 4 are not parallel with each other, it is not possible to uniformly crimp and fasten both end sections of the pivot 3 all the way around the beveled sections 12 formed around the peripheral edges of the openings of each through hole 11. In other words, since both end surfaces of the pivot 3 are at right angles with the center axis of the pivot 3, the positional relationship in the axial direction between both of these end surfaces and the beveled sections 12 is not uniform in the circumferential direction. In order to maintain sufficient crimping strength, it is necessary to have a proper positional relationship in the axial direction between both of the end surfaces and the beveled sections 12. However, as long as the outer side surfaces of the side-wall sections 4 are not parallel with each other, it is not possible to have a proper positional relationship all the way around the openings. Incidentally, it is unrealistic from the aspect of mass production to make both end surfaces in the axial direction of the pivot such that they are not parallel with each other in alignment with the outer side surfaces.

Therefore, conventionally, the positional relationship in the axial direction between the beveled sections 12 formed around the peripheral edges of the through holes 11 and both end surfaces of the pivot 3 is made to be proper on the opposite side from the connecting sections 5, 6 (lower side in FIG. 12), as shown in FIG. 12. Also, as shown by the dot-dash line $\alpha$ in FIG. 13, a crimping tool (punch) is pressed on a portion of the end surfaces of the pivot 3 from the middle to the side opposite to the connecting sections 5, 6, so that the edge of the portion from the middle to the side opposite to the connecting sections 5, 6 is crimped outward in the radial direction. Therefore, as shown in FIG. 14, the outer peripheral surface around the end section of the pivot 3 comes in contact with the inner peripheral surfaces of the through holes 11 at a section on the side closer to the connecting sections 5, 6 (on the upper side in FIG. 14). On the sides where the crimped sections 13 are formed, or in other words, on the sides opposite from the connecting sections 5, 6 (on the lower side in FIG. 14), there is a clearance 14 between the outer peripheral surface around the end sections of the pivot 3 and the inner peripheral surface of the through holes 11.

On the other hand, disclosed in Japanese Patent Publication No. Tokukai Hei 3-172506 is a technique for improving the manufacturing process of the sheet-metal rocker arm so as to keep the difference of the thickness in the width direction of the pair of sidewall sections, that support both ends of the pivot, to a minimum. In the case of this prior technique, first, a first intermediate blank 15 is made as shown in FIG. 15(A) by plastically deforming a piece of metal plate that will become the blank. Then, by performing a punching process on part of this first intermediate blank 15, a second intermediate blank 17 is formed having a hand-drum shaped through hole 16 in it as shown in FIG. 15(B). Next, a bending process is performed on both side sections of the through hole 16 of this second intermediate blank 17, so that the both side sections are raised to form a third intermediate blank 18 having a pair of side-wall sections 4*a* that are parallel with each other.

Furthermore, as shown in FIG. 16(A) and FIG. 16(B), through holes 11 are formed in alignment with each other on the side-wall sections 4 of this third intermediate blank 18, and a roller 2 is provided around the outer peripheral surface in the middle of a pivot 3, whose ends are both supported in the through holes 11. The roller 2 is supported by a radial needle roller bearing 19 such that it can rotate freely, to form the cam follower having a sheet-plate rocker arm. In the case of the invention disclosed in Japanese patent Publication No. Tokukai Hei 3-172506, the outer peripheral edges of both end surfaces in the axial direction of the pivot 3 are crimped outward all the way around. Therefore both end sections in the axial direction of the pivot 3 are supported inside the through holes 11 such that they are nearly concentric with the through holes 11.

In the first example of prior art construction shown in FIG. 14, since there is a clearance 14 between the outer peripheral surface around the end sections of the pivot 3 and the inner peripheral surface of the through holes 11 on the opposite side from the first and second connecting section 5, 6, the crimped sections 13 formed on the ends of the pivot 3 support the load applied to the pivot 3 from the cam 9 shown in FIG. 11 by way of the roller 2 (further by way of the radial needle roller bearing). In other words, when the engine is running, a load is applied to pivot 3 from the top side toward the bottom side in FIG. 14 (in balance with the elastic force of the return spring 10). Since there is a clearance 14 between the outer peripheral surface around the end sections of the pivot 3 and the inner peripheral surface of the through holes 11 in the direction where the load is applied, the crimped section 13 supports the load, and the load is not directly transmitted from the outer peripheral surface around the end sections of the pivot 3 to the inner peripheral surface of the through holes 11.

However, the area of contact between the crimped sections 13 and the beveled sections 12 is small, and since the crimped sections 13 are formed just by plastically deforming the ends of the pivot 3, it is easy for them to become plastically deformed. Therefore, after a long period of use, the crimped sections 13 plastically deform inward in the radial direction, and there is a possibility that the contact pressure between the crimped sections 13 and the beveled sections 12 will decrease. When the contact pressure decreases in this way, the pivot 3 and the roller 2 that is supported around the middle section of the pivot 3 are lashed with respect to the sheet-metal rocker arm 1, and thus vibration and noise occur so largely while the engine is running, which is not desirable.

In the case of the second example of prior art construction shown in FIG. 16, both ends in the axial direction of the pivot 3 are supported nearly concentrically radically inside the through holes 11, so that on the side where radial loads are supported, the thickness of the clearances between the outer peripheral surfaces around the ends in the axial direction of the pivot 3 and the inner peripheral surfaces inside the through holes 11 can be made smaller than in the case of the first example shown in FIG. 14. However, there is no secure direct contact between the outer peripheral surfaces around the ends in the axial direction of the pivot 3 and the inner peripheral surfaces inside the through holes 11 on the side where the radial loads are supported, so there is still a possibility that lost motion will occur due to plastic deformation of the crimped sections.

In JP patent publication No. Jitsuko Hei 4-44289, construction is disclosed in which the crimping position is regulated, so that the outer peripheral surfaces around the ends of the pivot come in contact with the inner peripheral surfaces of the through holes at the sections where the radial load is supported. However, the construction described in this disclosure is for a rocker arm made by casting, which differs from the cam follower of this invention having a lightweight and low cost sheet-metal rocker arm.

The cam follower of this invention was invented taking the aforementioned problems into consideration.

DISCLOSURE OF THE INVENTION

The cam follower of this invention comprises a sheet-metal rocker arm, pivot and roller.

The sheet-metal rocker arm is manufactured by plastic-working of a metal plate, and comprises a pair of sidewall sections, and connecting sections that connect this pair of sidewall sections. There is a pair of through holes formed in alignment with each other in these sidewall sections.

By crimping and opening up the outer peripheral edges around the ends of the pivot toward the inner peripheral surface of the pair of through holes, the pivot is attached to the pair of side wall sections such that it extends between the pair of sidewall sections.

Also, the roller is supported around the middle section of the pivot such that it can rotate freely.

Moreover, when in use, a load is applied to this pivot from the side of the connecting sections.

Particularly, in the cam follower of this invention, of the openings on both ends of the respective through holes, the peripheral edges around the openings on the side of the outside surface of the respective sidewall sections are beveled.

The thickness of the respective side-wall sections is not uniform due to the plastic-working. Here, the difference in the thickness of the respective side-wall sections between the portions around the respective through holes is adjusted such that it is smaller than (less than) the length in the axial direction of the beveled sections.

Furthermore, the outer peripheral edges around both end surfaces in the axial direction of the pivot are crimped around half of the peripheral edges of the through holes on the sides near the connecting sections. In addition, the outer peripheral surfaces of both end sections of the pivot come in contact with the inner peripheral surfaces of the respective through holes on the side away from the connecting sections.

In the case of the cam follower of this invention constructed as described above, as to the thickness of the respective side-wall sections which becomes uneven during plastic working, the difference of the thickness of the respective side-wall sections between the portions around the respective through holes is less than the length in the axial direction of the beveled sections, so it is possible to crimp the outer peripheral edges around the end surfaces of the pivot onto the beveled sections.

Also, the side where the load is supported, or in other words, in the load-support section, the outer peripheral surfaces around both ends of the pivot come in contact with the inner peripheral surfaces of the respective through holes over a large area. Moreover, in this load-support section, the outer peripheral surface sections around both ends of the pivot that come in contact with the inner peripheral surfaces of the respective through holes are not plastically deformed as are the crimped sections, so they are not easily plastically deformed even when large surface pressure is applied to them. Therefore, even when used for a long period of time, lost motion does not easily occur in the support sections on both ends of the pivot with respect to the sidewall sections of the sheet-metal rocker arm.

BEST MODE OF THE INVENTION FOR WORKING

Figure 1:
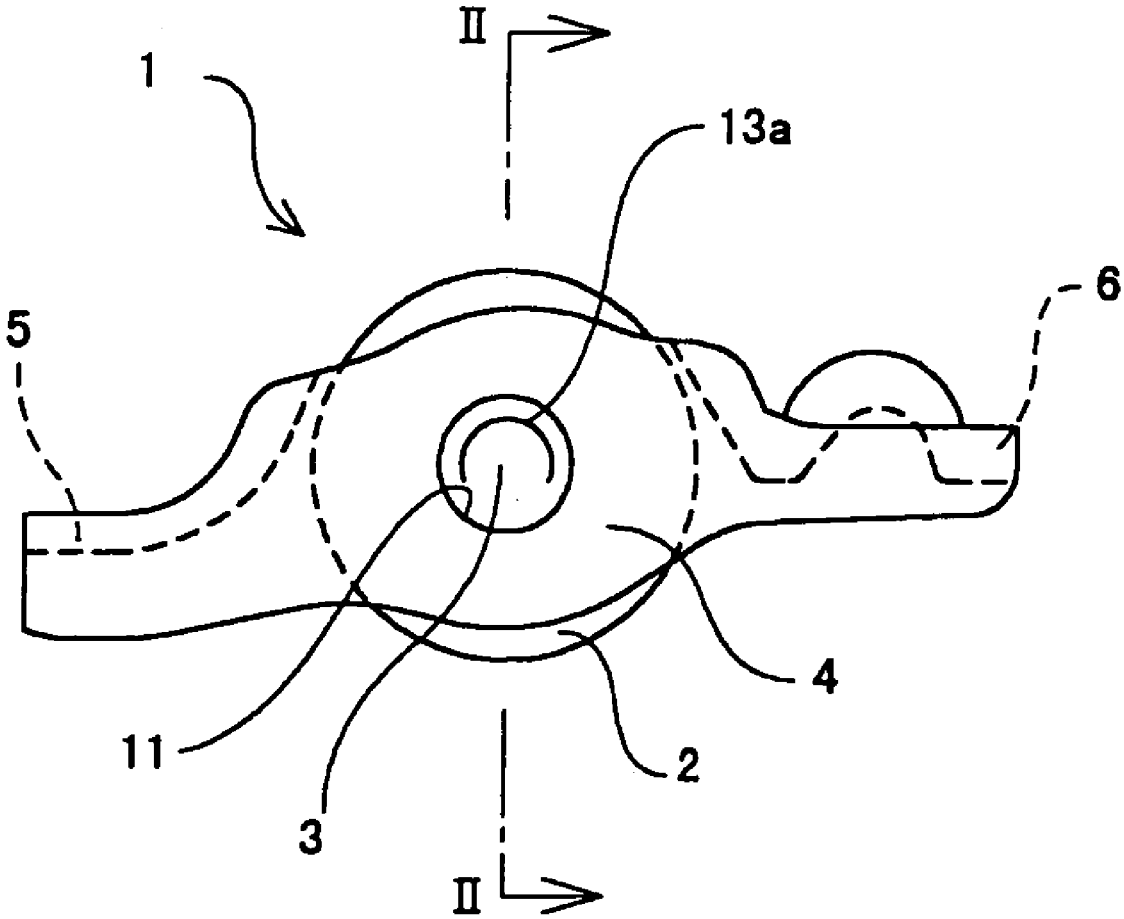
FIG. 1 is a side elevational view showing the cam follower according to a first example of the embodiment of the invention.
Figure 2:
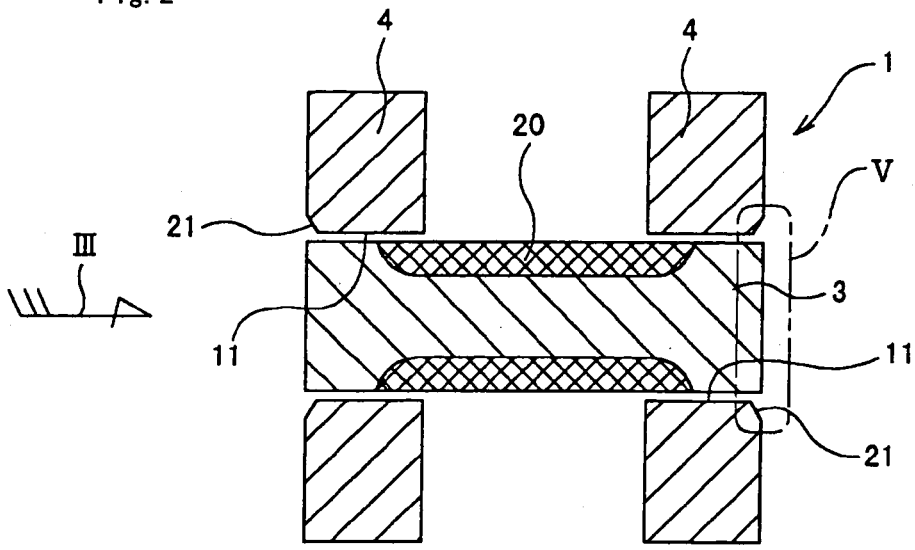
FIG. 2 is a cross-sectional view of the section taken along the line II—II in FIG. 1 and shows the state before both ends of the pivot of the cam follower are crimped with the radial-needle roller bearing and roller omitted.

A first example of the embodiment of the invention is shown in FIGS. 1 to 5. The feature of this invention resides in the construction of the part where a pair of sidewall sections 4 supports both ends of a pivot 3. The overall construction and function of the cam follower with sheet-metal rocker arm is substantially the same as the conventionally well-known construction, including the construction disclosed in U.S. Pat. No. 5,048,475, Japanese Patent Publication No. Tokuko Hei 6-81892, and Japanese Patent Publication No. Tokukai Hei 3-172506, so drawings and explanations are either omitted or simplified, and this explanation will center only on the features of this invention. Throughout all of the drawings, the same reference numbers are used for identical parts.

Similar to the first and second examples of prior art construction described above, the cam follower of this example comprises a sheet-metal rocker arm 1, roller 2 and pivot 3.

The sheet-metal rocker arm 1 is manufactured by plastic-working, specifically drawing of metal plate such as steel plate, and comprises: a pair of side-wall sections 4, and first and second connecting sections 5, 6 that connect the pair of side-wall sections 4. There are through holes 11 formed at locations in alignment with each other in the middle sections of each of the pair of sidewall sections 4, and both ends of a pivot 3 fit inside and are supported by these through holes 11 such that this pivot 3 extends between the sidewall sections 4. Of the openings on both sides of the respective through holes 11, beveled sections 21 having a partial concave conical shape are formed around the peripheral edges of the openings on the side of the outside surface of the side-wall sections 4 (surfaces on the side opposite from each other).

Moreover, a hardened layer 20 is formed by induction quench hardening all the way around the outer peripheral surface in the middle section of the pivot 3. In the example shown in the figure, the length in the axial direction of this quench hardened layer 20 is a little longer than the space between the inside surfaces of the side-wall sections 4. Accordingly, both ends of the hardened layer 20 are inserted inside the through holes 11. The outer peripheral surface of the middle section of this pivot 3 functions as the inner-raceway of the radial-needle roller bearing that supports the roller 2. However, neither of the ends of the pivot are hardened, but rather these ends are kept as they are in order that crimping sections 13*a* can be easily processed to fix the ends inside the through holes 11.

Figure 3:
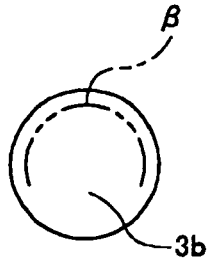
FIG. 3 is a view as seen from the direction III in FIG. 2, and shows the position where the crimping tool is pressed in order to crimp the both ends of the pivot.
Figure 4:
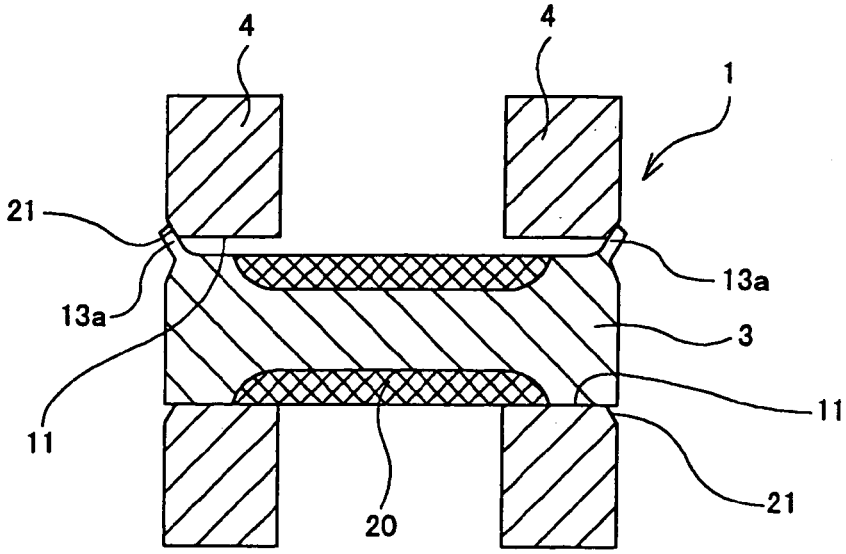
FIG. 4 is a drawing similar to that of FIG. 2, and shows the state after both ends of the pivot of the cam follower are crimped.

Also, the thickness of the pair of sidewall sections 4 is as uniform as possible in the width direction of the sidewall sections 4 (vertical direction in FIGS. 1 and 3). In other words, in the conventional processing method, when the sheet-metal rocker arm 1 is formed by performing plastic working on the metal plate, including drawing, the thickness of the side-wall sections 4 is inclined to be thin on the side near the first and second connecting sections 5, 6 (upper side in FIGS. 1, 2 and 4) and to become thicker going toward the side far from the connecting sections 5, 6 (lower side in FIGS. 1, 2 and 4). On the other hand, in the case of the sheet-metal rocker 1 used in this example, by tailoring the processing method for the sheet-metal rocker arm 1, the thickness of the side-wall sections 4 is kept as uniform as possible in the width direction.

Figure 5:
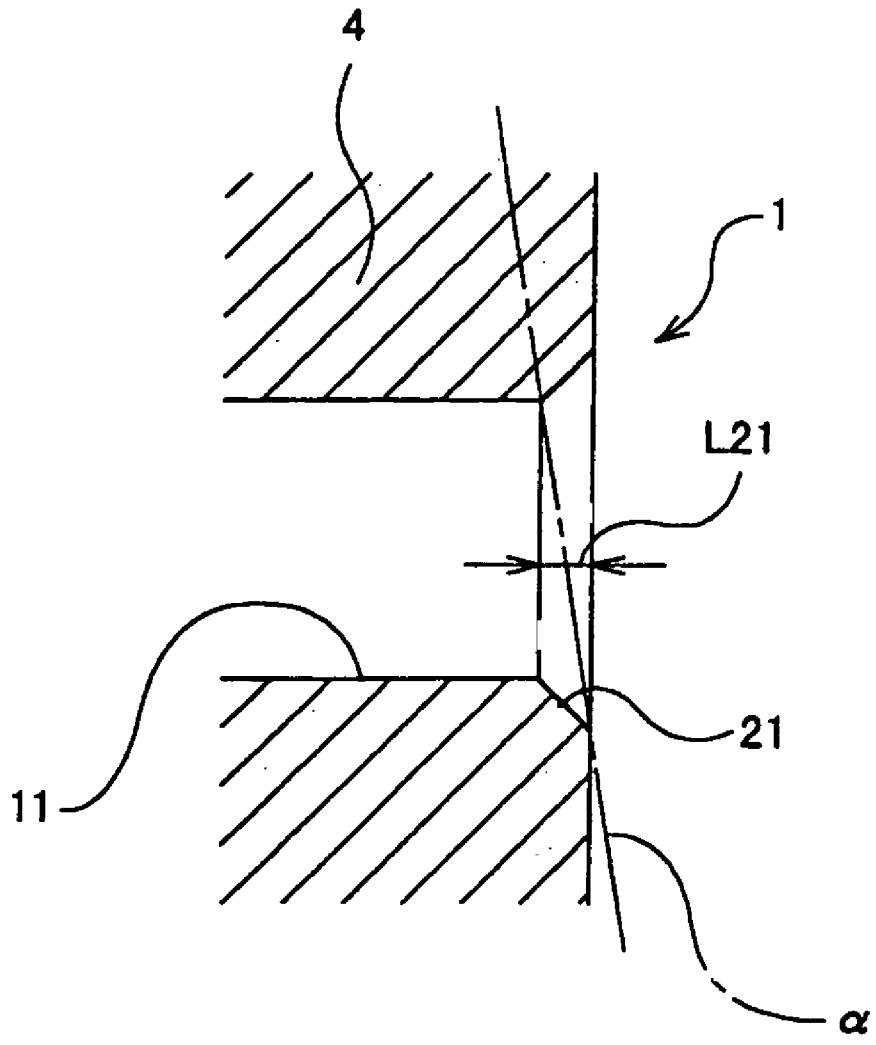
FIG. 5 is an enlarged view of the section V in FIG. 2, and shows the state before the pivot is inserted.

In regards to the thickness of the pair of side-wall sections 4, even though the thickness of the respective side-wall sections 4 becomes uneven due to plastic processing, the difference in the thickness of the side-wall sections 4 between the peripheral portions around the through holes 11 is at least less than the length $L_{21}$ (see FIG. 5) in the axial direction of the beveled sections 21. This will be explained using FIG. 5. The solid line in FIG. 5 shows the position of the outside surface where the thickness of sidewall sections 4 in the width direction is uniform. In this state, the outside surfaces of the pair of sidewall sections 4 are parallel with each other. On the other hand, with the sections where the thickness becomes non-uniform in the width direction due to plastic-working, or more specifically, with the pair of side-wall sections 4 when the side-wall sections 4 become thinner closer to the first and second connecting sections 5, 6, the inside surfaces of the side-wall sections 4 are kept parallel as necessary, and consequently the outside surfaces of the side-wall sections 4 become non-parallel with each other. That is, as shown by the dot-dash line $\alpha$ in FIG. 5, the outside surfaces are sloped such that the space between them becomes narrower the closer to the first and second connecting sections 5, 6.

Even when the outside surfaces of the side-wall sections 4 are not parallel with each other, the center axis of the beveled sections 21 usually coincides with the center axis of the through holes 11 due to processing reasons. Therefore, when adopting a typical processing method for keeping costs down, the width of the beveled sections 21 become non-uniform in the circumferential direction. However, the difference in the thickness at the peripheral portions around the through hole 11 is less than the length $L_{21}$ in the axial direction of the beveled section 21, so that this beveled section 21 is continuous in the circumferential direction, and never discontinued at any part of the circumference of the beveled section 21, more specifically even at the peripheral portion on the side near the first and second connecting sections 5, 6. The dot-dash line $\alpha$ in FIG. 5 shows the state where the maximum difference in the thickness of the sidewall sections 4 at the peripheral portions around the through holes 11 matches the length $L_{21}$ in the axial direction of the beveled section 21. On the other hand, in this example, since the difference in the thickness of the side-wall sections 4 at the peripheral portions around the through hole 11 is less than the state shown by the dot-dash line $\alpha$, or in other words, since the slope of the dot-dash line in this example is less than that $\alpha$ of the dot-dash line in FIG. 5, the outside surfaces of the sidewall sections 4 exist between the dot-dash line $\alpha$ and the solid line (the position of the outside surface where the thickness of side wall sections 4 is uniform.), and the beveled section 21 is continuous all the way around. In other words, the beveled section 21 is continuous even at the upper part of the through hole 11 in FIG. 5 where the thickness of the sidewall sections 4 is thinner.

Figure 11:
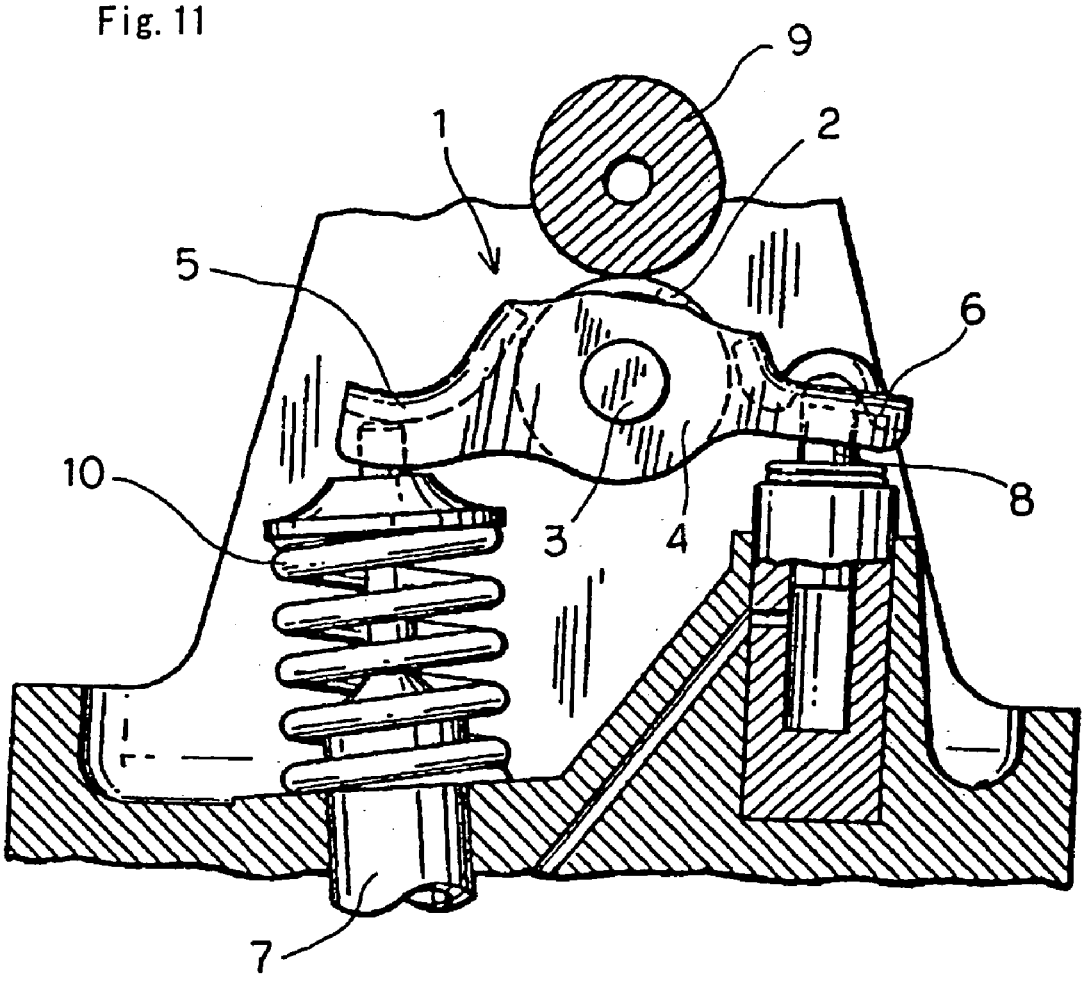
FIG. 11 is a cross-sectional view of part of the engine showing the state in which the cam follower is installed in the engine.
Figure 16:
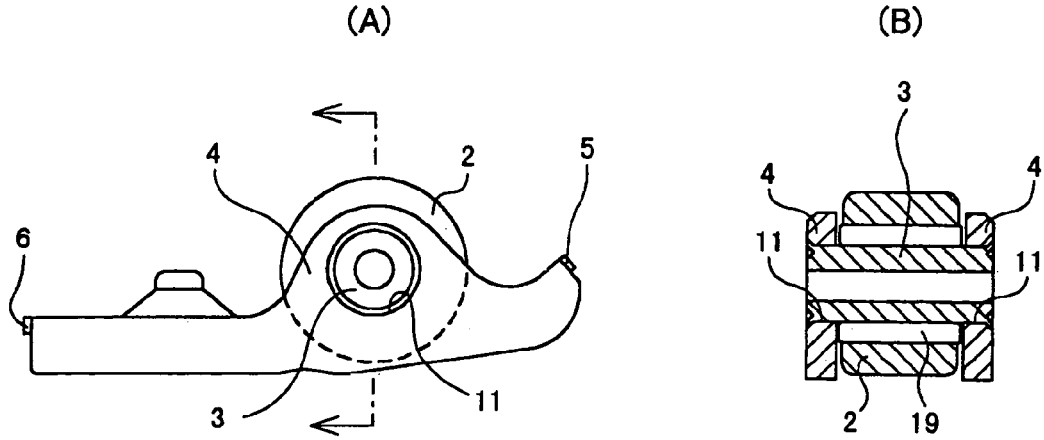
FIG. 16(A) is a side view of a cam follower apparatus with sheet-metal rocker arm that was manufactured by the processing procedure shown in FIGS. 15(A) to 15(F).
FIG. 16(B) is a cross-sectional view of the cam follower apparatus shown in FIG. 16(A), of a section indicated by the arrows.

The ends in the axial direction of the pivot 3 are attached to and supported by the sidewall sections 4 when the through holes 11 and beveled sections 21 are formed as described above. Also, the roller 2 is supported around the middle section of this pivot 3 by way of a radial-needle roller bearing 19 (see FIG. 16) such that it can rotate freely. When installed in the engine, a force (downward in FIGS. 1 to 5) is applied to the pivot 3 from the side of the first and second connecting section 5, 6 as the cam 9 turns (see FIG. 11).

In this example, in order to extend the pivot 3 between both side-wall sections 4, both ends of the pivot 3 are fitted inside the through holes 11, and the half on the side near the first and second connecting sections 5, 6 (top half in FIGS. 1 to 4) of the outer peripheral edges around both end surfaces of this pivot 3 are crimped. In order to do this, a crimping tool is pressed to part in the circumferential direction of each end of the pivot 3 from the middle section to the side near the first and second connecting sections 5, 6, to form a crimped section 13*a* on other side. When performing this crimping, the outer peripheral surfaces around the ends of the pivot 3 come in contact with the inner peripheral surfaces of the through holes 11 on the side away from the first and second connecting sections 5, 6 (lower side in FIGS. 1 to 4). In this case, the outer peripheral surfaces around the crimped sections 13*a* come in contact with the beveled sections 21. Also, due to processing of these crimped sections 13*a*, the ends of the pivot 3 are strongly pressed toward the side away from the first and second connecting sections 5, 6, and so the outer peripheral surfaces around the ends of the pivot 3 and the inner peripheral surfaces of the through holes 11 come in strong contact with each other on the side away from the first and second connecting sections 5, 6 (lower side in FIGS. 1 to 4).

In the case of the cam follower of this invention having this kind of construction, on the side where the load is supported, or in other words, in the load-support section, the outer peripheral surfaces around the ends of the pivot 3 come in contact with the inner peripheral surfaces of the through holes 11 over a wide area. Also, in this load-support section, the portion of the outer peripheral surface of the ends of the pivot 3 that come in contact with the inner peripheral surfaces of the through holes 11 did not undergo plasticall deformation like the crimped sections 13*a*, so they do not easily deform plastically even when large pressure is applied. Particularly, in the example shown in the figures, there is a quench hardened layer 20 on part of the outer peripheral surfaces around the both end sections of the pivot 3 that come in contact with the inner peripheral surfaces of the through holes 11. This quench hardened layer 20 is hard and is very difficult to deform (especially, plastically deform). Therefore, even when used for a long period of time, it is difficult for lost motion to occur in the support sections of the ends of the pivot 3 with respect to the sidewall sections 4 of the sheet-metal rocker arm 1. Moreover, the respective crimped sections 13*a* fit along their entire length with the beveled sections 21, so the fitting strength between these crimped sections 13*a* and the side-wall sections 4 can be sufficiently maintained.

Figure 6:
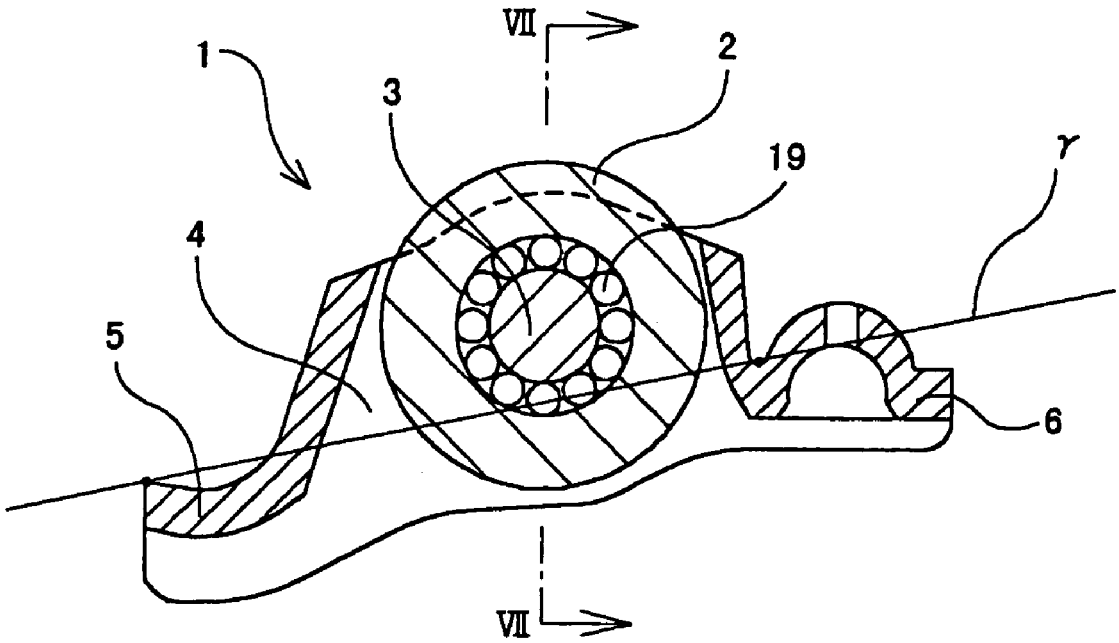
FIG. 6 shows a second example of the embodiment of the invention, and is a cross-sectional view as seen from the same direction as in FIG. 1.

In the case of working this invention, the processing method for making the thickness of both of the side-wall sections 4 as uniform as possible in the width direction can be conducted according to the method shown in FIGS. 15(A) to 15(F) and disclosed in Japanese Patent Publication No. Tokukai Hei 3-172506, or to a drawing process after a punching and bending process as disclosed in Japanese Patent Publication No. Tokukai Hei 5-272310, or to a method of making the thickness uniform by swaging a thick metal plate in the planar direction. It is also possible to use a combination of the methods disclosed in the aforementioned disclosures and the method of swaging a thick metal plate in the planar direction. Of these methods, the method of swaging a thick metal plate in the planar direction is preferred in the case of manufacturing a so-called high-center-of-gravity cam follower in which, as shown in FIG. 6, the pivot 3 is located further on the side (top side in FIG. 6) of the cam 9 (see FIG. 11) than the imaginary line γ that connects the ends of the first and second connecting sections 5, 6 and the spherical seat and raised section of support of roller 2.

Figure 7:
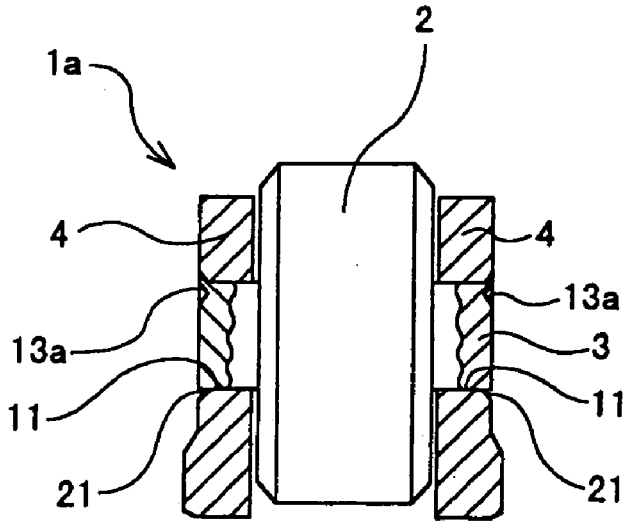
FIG. 7 is a cross-sectional view of the section taken along the line VII—VII in FIG. 6.
Figure 8:
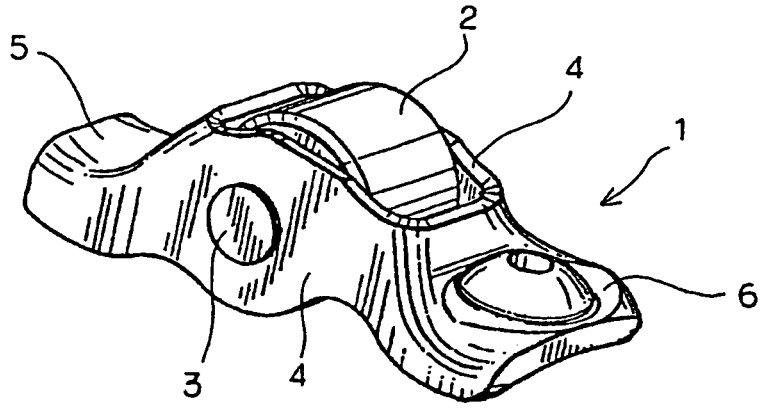
FIG. 8 is an isometric view showing an example of a cam follower having a prior art sheet-metal rocker arm.
Figure 9:
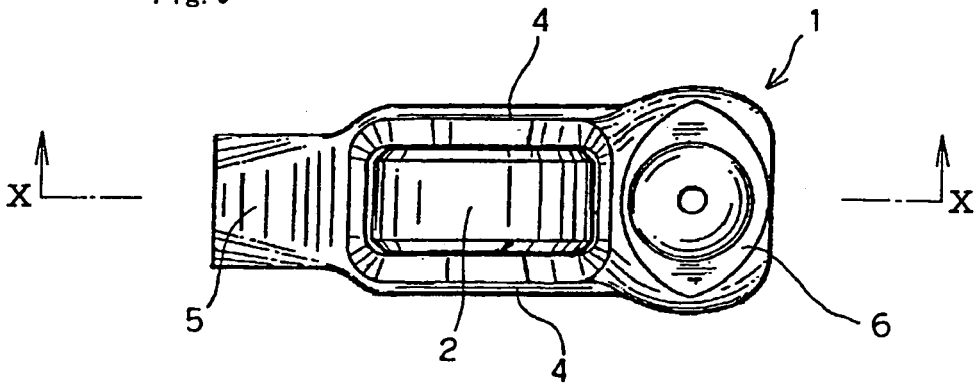
FIG. 9 is a top plan view as seen from above in FIG. 8.
Figure 10:
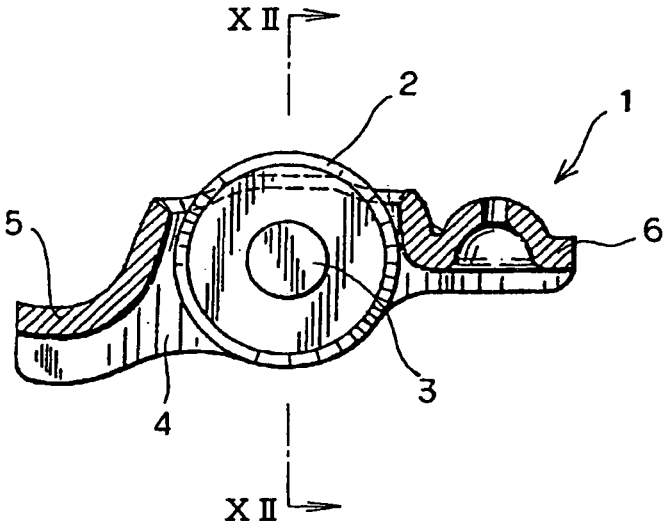
FIG. 10 is a cross-sectional view of the section taken along the line X—X in FIG. 9.
Figure 12:
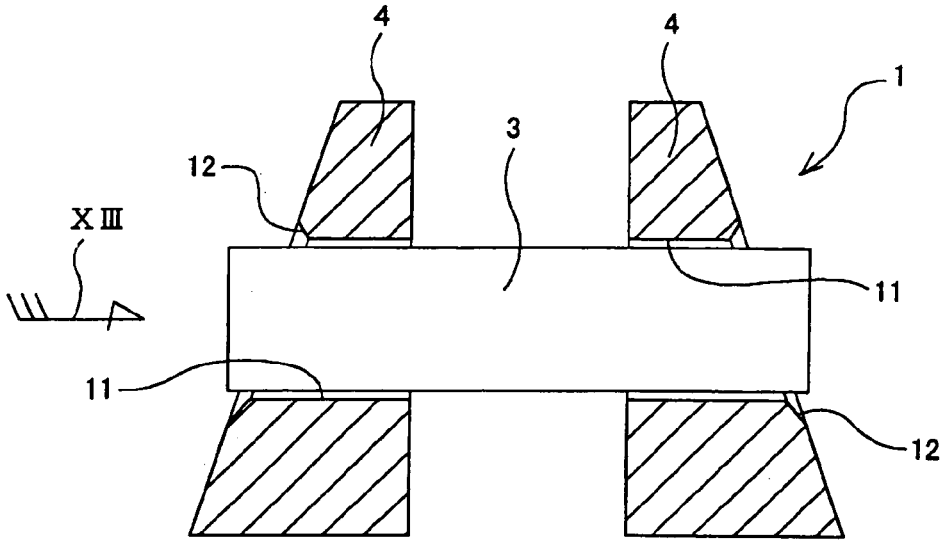
FIG. 12 is a cross-sectional view of the section taken along the line XII—XII in FIG. 10, and is an exaggerated view of the difference of thickness and shows the state before crimped sections are formed on the ends of the pivot.
Figure 13:
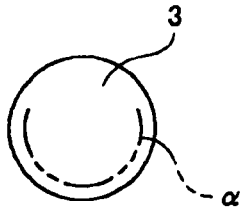
FIG. 13 is a view as seen from the direction XIII in FIG. 12 and shows the position where the crimping tool is pressed to crimp both ends of the pivot.
Figure 14:
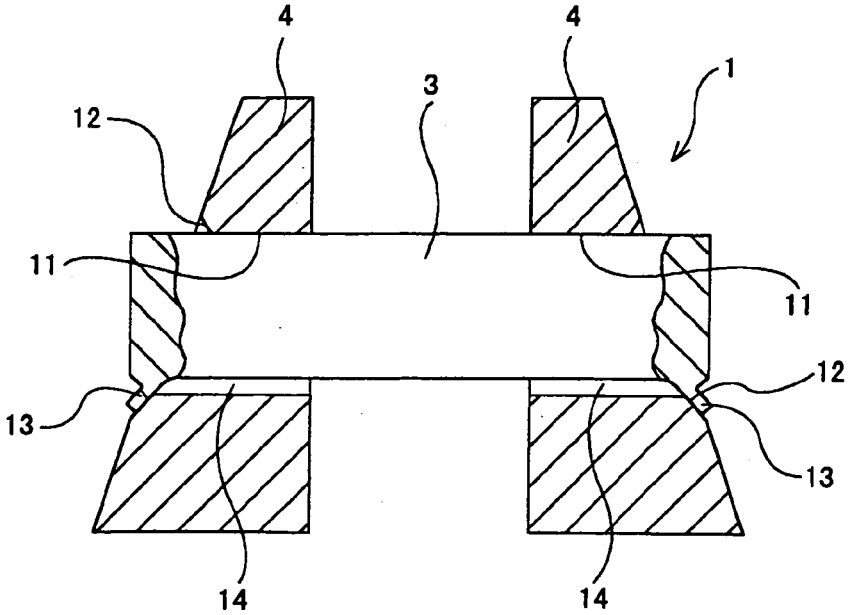
FIG. 14 is a drawing similar to FIG. 12, and it shows the state after crimping both ends of the pivot.
Figure 15:
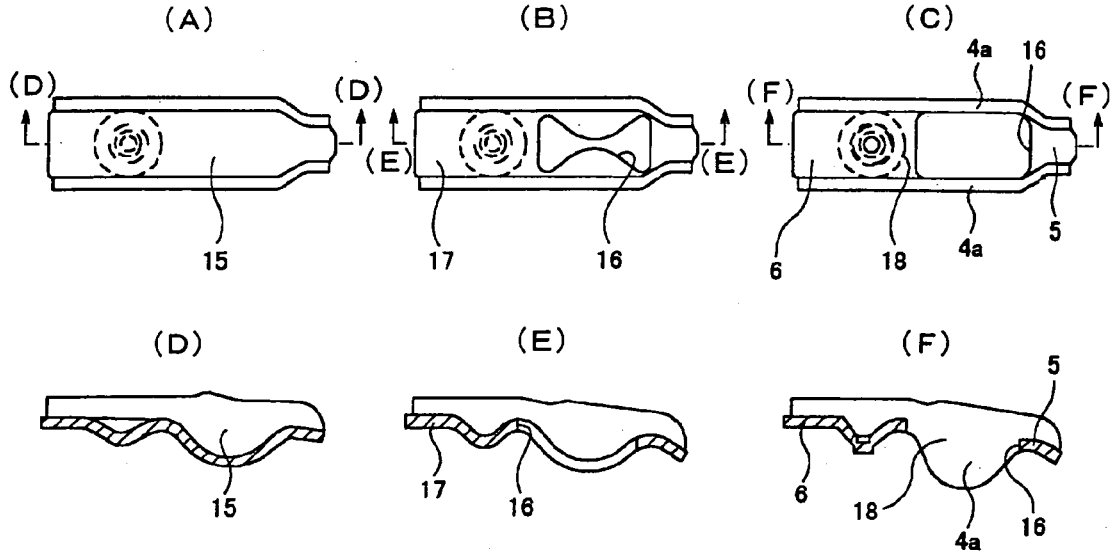
FIGS. 15(A) to 15(C) are top plan views showing the processing procedure of the manufacturing method for a prior art sheet-metal rocker arm.
FIGS. 15(D) to 15(F) are cross-sectional views from the side of a section taken through the center of FIGS. 15(A) to 15(C).

It is difficult to manufacture the sheet-metal rocker arm of this kind of high-center-of-gravity cam follower using the method shown in FIGS. 15(A) to 15(F), and the metal plate must be drawn in a large amount. Therefore, it becomes very easy for the thickness of the sidewall sections 4 to become non-uniform in the width direction as shown in FIGS. 12 and 14 described above. In this case, a thick metal plate is used as the metal plate for manufacturing the sheet-metal rocker arm, and this metal plate is swaged in the planar directions around the area of the through holes 11 so that the plate thickness in the peripheral portions around the through holes 11 is as uniform as possible. Here, as to the portion spaced from the peripheral portions of the through holes 11, as shown in FIG. 7, it can remain thick. By doing so, the thickness of the side-wall sections 4 in the width direction can be made uniform in the center section that supports the ends of the pivot.

INDUSTRIAL APPLICABILITY

This invention is constructed and functions as described above and is capable of improving the durability of a cam follower having a lightweight and low-cost sheet-metal rocker arm.

What is claimed is:

1. A cam follower comprising a rocker arm, pivot and roller, (1) the rocker arm is:

(1a) made from a metal plate through a drawing process, and comprises (1b) a pair of side wall sections, (1c) connecting sections to connect the pair of side wall sections, (1d) the pair of side wall sections having a pair of through holes in alignment with each other, (1e) the through holes having openings at the opposite ends, wherein the openings on the outside surface side of the respective side wall sections are formed with a beveled section along the peripheral portion thereof, (1f) the side wall sections having a thickness which is uneven due to the drawing process, wherein the difference of the thickness at the peripheral portions of the through holes is less than the length in the axial direction of the beveled section, (2) the pivot:

(2a) has the outer peripheral edge on the opposite end surfaces thereof, and (2b) is fitted into the pair of through holes to extend between the pair of side wall sections, (2c) provided that the connecting side is on the upper side while the opposite side to the connecting side is on the lower side, the outer peripheral edge of the opposite end surfaces in the axial direction of the pivot being crimped toward the upper side of the peripheral portion of the through hole, and (3) the roller being supported rotatably around the middle portion of the pivot.

2. The cam follower of claim 1, wherein each of the opposite end surfaces in the axial direction of the pivot exists between the axial position of the highest point in the inner peripheral circle of the beveled section and the axial position of the lowest point of the inner peripheral circle with reference to the rocker arm.

3. The cam follower of claim 1, wherein the middle portion of the pivot, facing the inner periphery side of the roller, is quench-hardened, and wherein the crimped portion on the outer periphery of the pivot is kept as it is and not subjected to quench-hardening.

* * * * *